United States Patent [19]

Wackrow

[11] Patent Number: 4,883,042

[45] Date of Patent: Nov. 28, 1989

[54] AIR GUNS

[75] Inventor: Roger D. Wackrow, Redditch, England

[73] Assignee: BSA Guns (UK) Limited, United Kingdom

[21] Appl. No.: 166,392

[22] Filed: Mar. 10, 1988

[30] Foreign Application Priority Data

Mar. 13, 1987 [GB] United Kingdom ..... 8705994

[51] Int. Cl.[4] ..... F41B 11/00

[52] U.S. Cl. ..... 124/67; 124/38

[58] Field of Search ..... 124/67, 66, 37, 38, 124/40, 27

[56] References Cited

U.S. PATENT DOCUMENTS

| | | | |
|---|---|---|---|
| 2,572,176 | 10/1951 | Mihalyi | 124/67 |
| 3,142,294 | 7/1964 | Baldwin, Jr. | 124/67 |
| 4,367,723 | 1/1983 | Resuggan | 124/67 |

FOREIGN PATENT DOCUMENTS

| | | | |
|---|---|---|---|
| 1038446 | 9/1958 | Fed. Rep. of Germany | 124/67 |
| 1250763 | 9/1967 | Fed. Rep. of Germany | 124/67 |
| 2526896 | 1/1976 | Fed. Rep. of Germany | 124/67 |
| 1423153 | 1/1976 | United Kingdom | 124/67 |

*Primary Examiner*—Andrew V. Kundrat
*Assistant Examiner*—Peter M. Cuomo
*Attorney, Agent, or Firm*—Leydig, Voit & Mayer

[57] ABSTRACT

An air gun of the break-barrel type has a spring-urged piston working in a bore of a cylinder. The piston has two axially spaced latched cocking positions in the cylinder; an intermediate position in which the spring is only partially compressed, and a fully cocked position in which the spring is fully compressed. The piston is held in each of its latched positions by the co-operation, in turn, of a sear with a one of a pair of axially spaced grooves in the piston. Initial downward swivelling of the barrel causes a cocking bar pivotally connected to the barrel to engage in the rearward groove and force the piston backwards to its intermediate position. The gun can then be fired with reduced power or alternatively a second cocking stroke performed in which the cocking bar engages in the forward groove and urges the piston to its fully cocked position. Instead of having a breaking breech, the gun may operate by a cocking lever. The piston may have more than one latch intermediate position in the bore.

7 Claims, 3 Drawing Sheets

AIR GUNS

This invention relates to air guns of the kind in which a piston is pulled back against a main spring during a cocking action and held there by a sear. The sear is released by pressing a trigger and the piston flies forward in a cylinder compressing air to expel a pellet from the barrel. The air gun, which may be a rifle or a pistol, may have a barrel which is fixed in relation to a body housing the piston and cylinder and a separate cocking lever for cocking the piston or be of the break-barrel type in which the barrel is pivotally mounted on the body. The barrel is swung about the pivot to open the breech for loading. This movement of the barrel also serves to cock the piston. One end of a cocking bar is swivelly connected, directly or indirectly, to the barrel close to the pivot so that, when the breech is broken and the barrel swung down, the other end of the cocking bar engages the piston to force it back. An air gun with a separate cocking lever can be cocked in a similar way by manipulation of the cocking lever. Such air guns, whether cocked by moving the barrel or a separate cocking lever, are hereinafter referred to as of the kind described. The main spring may be in the form of a coil spring or gas spring or any suitable mechanically equivalent device.

According to the invention we provide an air gun of the kind described in which the spring may be compressed in stages, the piston having at least first and second axially spaced positions in the bore at which the piston is held in the bore by holding means and in which positions the spring is at least partially compressed, the gun including interengeable means for enabling the cocking bar to engage the piston so as to move the piston during a stroke of the barrel, or cocking lever, in a first stage along the cylinder to the first position at which it is retained by the holding means while the barrel, or cocking lever, is returned to enable the cocking bar to re-engage the piston so as to enable another stroke of the barrel, or cocking lever, to move the piston in a second stage from the first position to the second position.

In a conventional air gun of the kind described, a certain stroke of the cocking bar is required to compress the main spring fully to cock the gun. The stroke of the cocking bar is determined by the distance between its point of connection to the barrel (or cocking lever) and the pivot axis of the barrel, and by the available rotational cocking movement of the barrel. For practical purposes the latter is fixed, and the former is therefore effectively predetermined by the stroke required. However, the former also determines the mechanical advantage gained between the barrel and the cocking bar. Since, again for practical purposes, the barrel length is predetermined, and the available cocking movement is so limited, the force which can be applied to the cocking bar is limited by the stroke required to compress the spring. The maximum force which the user of the gun can be expected to exert on the barrel, or cocking lever, therefore limits the strength of the main spring and consequently the firing velocity. Since the arrangement in accordance with the invention provides for the spring to be compressed in stages, relatively short strokes of the cocking bar can be employed, which permits the mechanical advantage of the cocking mechanism to be increased and a stronger main spring to be fitted. A higher velocity can so be obtained without requiring excessive force to be used in order to cock the piston. Furthermore, the advantage is provided that the weapon can be fired at more than one power setting, which can be of benefit in enabling a high power weapon to be used at lower power when required, for example in indoor shooting.

Usually movement of the piston in two stages, that is to say by two working strokes of the barrel or cocking lever, will be sufficient but three or more stages could be arranged to enable an exceptionally powerful main spring to be fitted or to reduce the force required to move the barrel or cocking lever.

The interengageable means between the cocking bar and the piston preferably comprises at least one driving formation on the cocking bar engageable in turn with two or more axially spaced formations on the piston. Alternatively, it would be possible for two or more driving formations to be provided on the cocking bar to engage in turn a single formation on the piston.

The holding means preferably comprises at least one latching formation engageable in turn with two or more axially spaced complementary latching formations provided on the piston.

The holding means may also engage the formation or formations on the piston with which the driving formation is engageable and may be formed by the sear releasable by the trigger.

An embodiment of the invention will now be described, by way of example, with reference to the accompanying drawings, in which.

Figure 1:
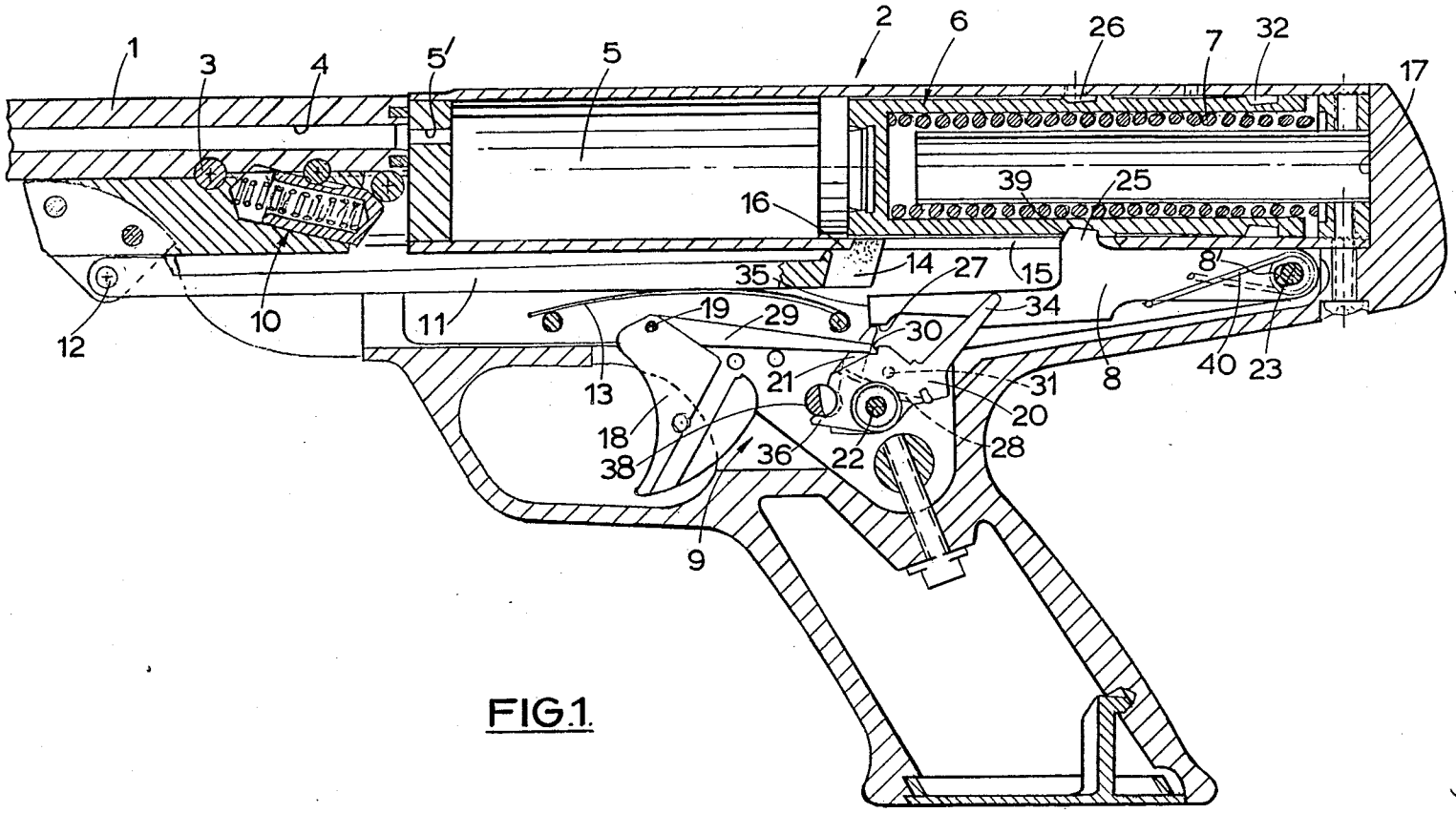
FIG. 1 is a longitudinal section through an air pistol according to the invention.

The air pistol shown in the drawings is of the break-barrel type in which a barrel 1 is pivotally connected to a body 2 by a pivot 3 around which the barrel 1 can be swung to cock the pistol and to enable a pellet (not shown) to be loaded into the bore 4 of the barrel 1 at the breech. The body 2 comprises a cylinder 5 in which works a piston 6 actuated by a main spring 7. In FIG. 1 the piston 6 is shown in the cocked position with the main spring 7 fully compressed. The piston 6 is retained in the cocked position by a sear 8 releasable by a trigger mechanism 9. When the trigger is pressed, the main spring 7 moves the piston 6 forwards, that is to say to the left as viewed in FIG. 1, compressing air in the cylinder 5. The air passes through a port 5' at the end of the cylinder and expels the pellet from the pistol along the bore 4 of the barrel.

The barrel 1 is kept in the firing position shown in FIG. 1 with the breech closed by a self-latching catch mechanism 10 of any suitable known form. One end of a cocking bar 11 is swivelly connected to the barrel by a pin 12 near the pivot 3. The other end of the cocking bar 11 is bifurcated and lies in the body below the cylinder 5 towards which it is urged by a bow-spring 13. Tines 14 of the forked end of the cocking bar 11 are upturned and enter an axial slot 15 in the underside of the wall of the cylinder 5. Close to the upturned portion the tines 14 are formed with a ledge 16 which, when the breech is closed and as shown in FIG. 1, engages the marginal portion of the wall of the barrel at the forward end of the slot 15 to hold the tips of the tines out of the cylinder cavity and away from the piston 6.

the distance between pivot 3 and pin 12 is short, providing a relatively high mechanical advantage between the barrel and the cocking bar.

The piston 6 is held in a cocked position as shown in FIG. 1, in which the main spring 7 is held in compression between the piston 6 and a rear wall 17 of the cylinder, by the sear 8. The trigger mechanism 9 may be of any suitable known form but in this instance comprises a trigger 18 pivotally mounted on a pivot pin 19, a hammer 20 and an intermediate sear 21 both pivotally mounted on a pin 22. The main sear 8 is pivotally mounted on a pin 23 by a hole 8' which is slightly elongated to allow some movement of the sear 8 along its length relative to the pin 23. In the cocked position shown in FIG. 1 a latching stepped portion 25 of the main sear 8 engages the rear edge of a forward recess formed by a circumferential groove 26 in the piston 6 and is prevented from moving pivotally under the action of the main spring 7 by the intermediate sear 21 which engages a lower face 27 of the free end of the main sear 8. The hammer 20 is held in a cocked position, against the action of a two-legged torsion spring 28 which engages the hammer 20 and the intermediate sear 21, by a trigger bar 29 which engages a detent 30 in the hammer member.

To fire the pistol, the trigger 18 is pressed thus disengaging the trigger bar 29 from the detent 30 and allowing the hammer 20 to move pivotally under the action of the spring 28 anticlockwise as viewed in FIG. 1. A projection 31 on the rear face of the hammer as viewed in FIG. 1 strikes the edge of the intermediate sear and dislodges it from the lower face of the main sear 8. The action of the main spring disengages the main sear 8 from the piston 6 which moves forward in its firing stroke.

Figure 2:
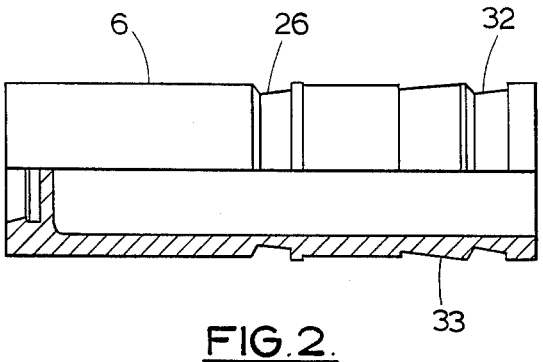
FIG. 2 is a side view partly in section of a piston of the air pistol.

As is more clearly shown in FIG. 2, in addition to the forward circumferential groove 26, the piston is provided with a similar rearward recess formed by a circumferntial groove 32. Adjacent the forward edge of the groove 32, the piston wall has a forwardly tapering portion forming a slope or ramp 33 the purpose of which will be referred to later. The larger end of the tapering portion and lands to the rear of each of the grooves 26 and 32 represent the maximum diameter of the piston; all the remaining portions of the circumferential surface of the piston are relieved so that they do not make contact with the surface of the cylinder 5.

Instead of the circumferential grooves 26 and 32, straight grooves similar in cross-section to the grooves 26 and 32 may be machined across the underside of the piston 6, the base of the channel conforming to a chord of the circumference of the piston 6.

Figure 3:
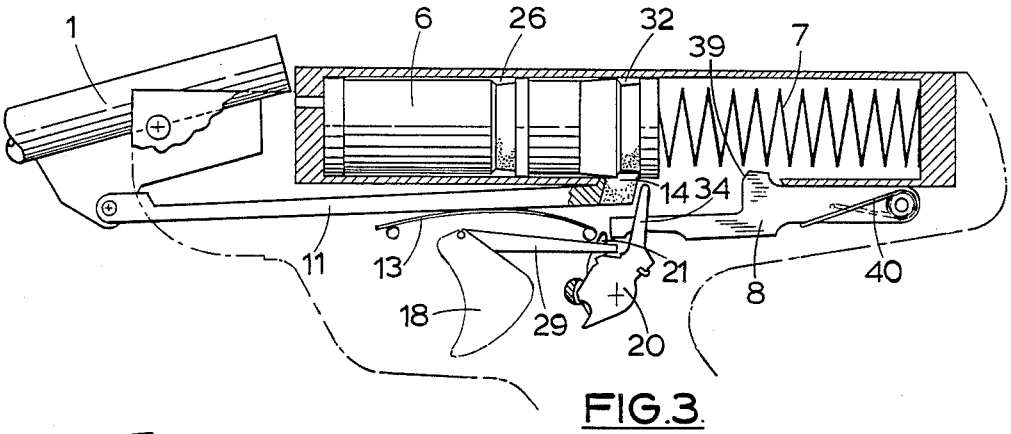
FIGS. 3 to 7 are diagrammatic views similar to FIG. 1, but on a smaller scale, showing various stages in the operation of the pistol shown in FIG. 1.

FIG. 3 shows the relative position of the components after firing and at the start of the cocking movement when the barrel has just been broken down. The cocking bar 11 has been moved rearwards far enough to disengage the ledge 16 from the wall of the cylinder 5 in front of the slot 15 and allow the bow spring 13 to urge the tines 14 against the piston 6 so as to engage the rearward groove 32. Further downward movement of the barrel moves the cocking bar 11 rearwards. The cocking bar 11 takes the piston with it and also engages an arm 34 of the hammer 20 and moves it in a clockwise direction as viewed in FIG. 3. This brings the intermediate sear 21 against an end face 35 of the main sear 8 which prevents it from moving with the hammer 20 thus tensioning the torsion spring 28. Clockwise movement of the hammer 20 continues until a lower arm 36 of a forked part of the hammer 20 comes into contact with the lower lip of a groove 37 in a rotatably mounted safety rod 38. In the ready-to-fire position, the groove 37 will receive the hammer 20 when the safety rod 38 is in the "off" position. Further clockwise movement of the hammer 20 during cocking causes the engagement of the lower arm 36 with the lip of the groove 37 to rotate the safety rod 38 to an "on" position in which the groove 37 will no longer admit the hammer 20. The hammer 20 is held cocked and the trigger bar 29 drops in front of the detent 30 ready to re-engage it when the safety rod 38 is turned to the "off" position.

Figure 4:
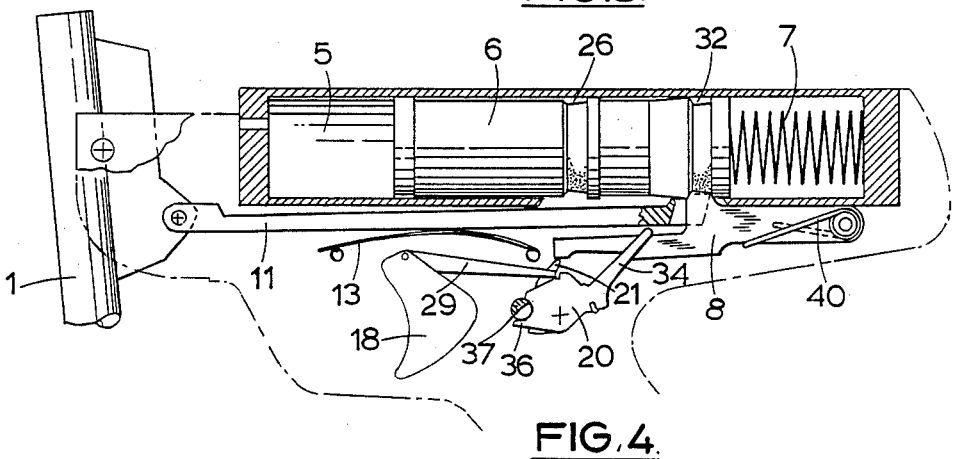
Figure 6:
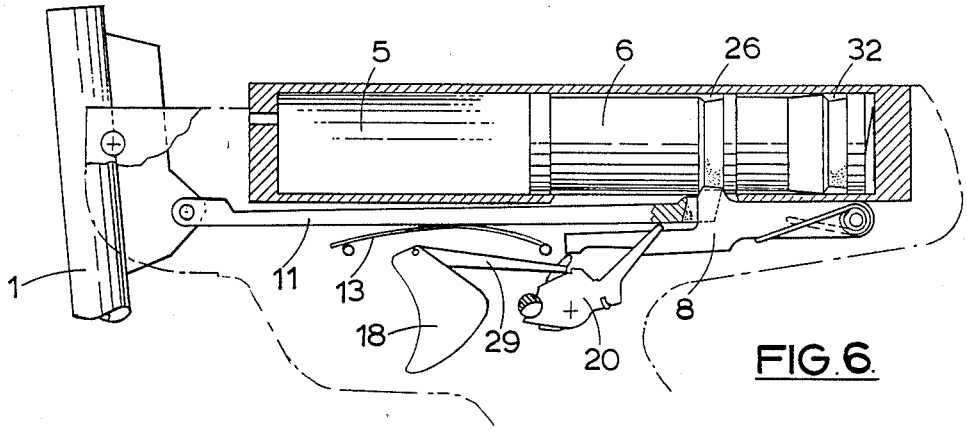
Figure 7:
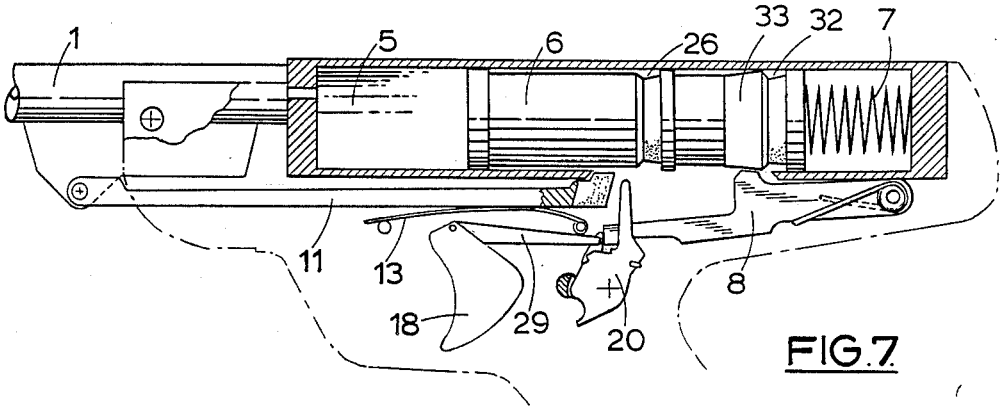

A front corner 39 of the stepped portion 25 of the main sear 8 is chamfered and when the rear edge of the piston 6 reaches the sear, the piston engages the chamfered corner 39 and pushes the main sear 8 out of the way turning the sear 8 anti-clockwise about its pivot 23 against the action of a torsion spring 40. In the final stage of downward movement of the barrel the tines 14 of the cocking bar 11 embrace the stepped portion 25 and the piston 6 reaches the position shown in FIG. 4 in which the stepped portion 25 enters the rearward groove 32. The intermediate sear 21 engages the lower face 27 of the main sear 8 to hold the main sear 8 in against the action of the main spring 7 when pressure on the barrel 1 is relaxed. The barrel is then swung forwards and upwards towards its initial position. The front edge of the groove 32 is inclined and pushes the prongs 14 out of the groove against the action .of the bow spring 13. The barrel can be returned to the fully closed position in which it appears in FIG. 1 and with the tines 14 held away from the piston 6. The pistol could be fired in this condition at lower velocity with the main spring 7 only partly compressed. If, however, the main spring is to be fully compressed the barrel 1 need only be brought back to the attitude shown in FIG. 5 in which the tines 14 enter the forward groove 26. Swinging the barrel downwards and rearwards a second time moves the piston rearwards, taking the sear with it to the extent allowed by the elongation of the hole 8'. The rearward movement of the sear 8 is sufficient to disengage its lower face 27 from the intermediate sear 21. On further rearward movement of the piston 6 co-operation of the chamfered corner 39 of the main sear with the inclined front edge of the rear groove 32 pushes the main sear 8 out of the groove 32 its end face 35 passing down behind the intermediate sear 21. As the full stroke of the barrel movement is completed, the tines 14 again embrace the stepped portion 25 of the main sear which this time enters the forward groove 26 to hold the piston 6 in the cocked position with the main spring 7 fully compressed. When rearward pressure on the barrel 1 is released the action of the main spring moves the piston 6 forwards, and with it the main sear 8 to the extent allowed by the hole 8'. This movement brings the lower face 27 over the intermediate sear 21 The components are then in the position shown in FIG. 6 with the piston 6 cocked, the main sear 8 being kept in engagement with the groove 32 by the intermediate sear 21. The barrel 1 is then returned to the closed position and the components occupy the positions shown in FIG. 1. When the pistol is fired from this condition engagement of the stepped portion 25 with the rearward groove 32 must be avoided as the piston passes. It is for this purpose that the slope or ramp 33 is provided on the piston. As the piston moves forward the stepped portion 25 engages the slope or ramp 33, as shown in FIG. 7. Owing to the velocity the piston has reached at this point and the inertia of the main sear 8, the slope or ramp 33 deflects the main sear 8 sufficiently and for a long enough time to allow the groove 32 to go past before the stepped portion 25 re-enters the cylinder.

Figure 5:
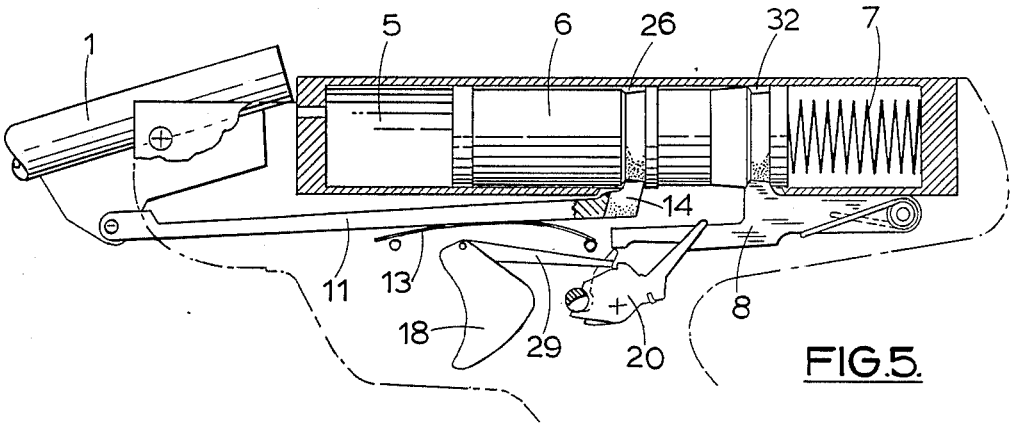

When the pistol is fired after double cocking action, so that the condition is as shown in FIG. 1 with the main spring 7 fully compressed, a higher pellet velocity can be obtained than when it is fired in the condition previously described in which the piston is in the position shown in FIG. 5 with the main spring only partly compressed.

We claim:

1. An air gun having a barrel and comprising a piston which is engaged by a cocking bar during a cocking stroke to force the piston back within a cylinder having a bore and a main spring acting against the piston therein, the piston being held against the compressed main spring by a sear and a trigger mechanism retaining the sear in engagement with the piston until the gun is fired, upon which the sear becomes displaced by the piston permitting the piston to fly forwards in the cylinder and so compressing air within the cylinder to expel a pellet from the barrel of the gun, the piston having at least first and second axially spaced positions in the bore at which it can be held in the bore by the sear and in which positions the spring is at least partially compressed, the gun including interengeable means for enabling the cocking bar to engage the piston so as to move the piston during a first cocking stroke in a first stage along the cylinder to the first position at which it is retained by the sear while the cocking bar is returned to enable the cocking bar to re-engage the piston so as to enable a second cocking stroke to move the piston in a second stage from the first position to the second position, the sear comprising at least one latching stepped portion which is engageable in turn with at least a pair of axially spaced, forward and rearward, complementary recesses provided on the piston, and the piston forming a rearwardly rising ramp at a location between said forward and rearward recesses and adjacent to the rearward recess, whereby when the gun is fired from a cocked condition in which the piston is held at least by the engagement between the latching portion and the forward recess the latching portion is displaced from its engagement with the forward recess and slidingly engages the piston, sliding up the ramp as the piston flies past and, being so deflected outwardly past the rearward recess.

2. An air gun according to claim 1, in which the interengageable means between the cocking bar and the piston comprises at least one driving formation on the cocking bar engageable in turn with said axially spaced recesses on the piston.

3. An air gun according to claim 1 which when the piston is in the first position can at the choice of the user either be fired with reduced power or the spring compressed further by another stroke of the cocking bar.

4. An air gun according to claim 1, in which the piston is movable to the first position upon an initial stroke of the cocking lever and to the second position upon the second stroke of the cocking bar, the sear having a first axial position during said initial stroke and a displaced axial position during said second stroke, the gun being de-cocked when the sear is in the displaced axial position.

5. An air gun according to claim 4, in which the sear is supportable in a projecting position in which it projects into the cylinder by an intermediate sear, displacement of the sear to the displaced position disengaging the sear and the intermediate sear to allow the sear to move out of the cylinder.

6. An air gun according to claim 5 which requires only two strokes of the barrel or cocking lever to compress the spring fully.

7. An air gun according to claim 1, in which said forward and rearward recesses are formed by circumferential grooves in the piston.

* * * * *